US008453712B2

(12) United States Patent
d'Hone

(10) Patent No.: US 8,453,712 B2
(45) Date of Patent: Jun. 4, 2013

(54) METHOD AND TWIN ROLL CASTER FOR THE PRODUCTION OF STRIP CAST FROM A MOLTEN METAL

(75) Inventor: André d'Hone, Krefeld (DE)

(73) Assignee: Outokumpu Nirosta GmbH, Krefeld (DE)

( * ) Notice: Subject to any disclaimer, the term of this patent is extended or adjusted under 35 U.S.C. 154(b) by 0 days.

(21) Appl. No.: 12/918,190

(22) PCT Filed: Feb. 20, 2009

(86) PCT No.: PCT/EP2009/052064

§ 371 (c)(1),
(2), (4) Date: Oct. 20, 2010

(87) PCT Pub. No.: WO2009/103802

PCT Pub. Date: Aug. 27, 2009

(65) Prior Publication Data

US 2011/0024074 A1 Feb. 3, 2011

(30) Foreign Application Priority Data

Feb. 22, 2008 (DE) ..... 10 2008 010 653

(51) Int. Cl.
*B22D 11/06* (2006.01)

(52) U.S. Cl.
USPC ..... 164/428; 164/480

(58) Field of Classification Search
USPC ..... 164/428, 480
See application file for complete search history.

(56) References Cited

U.S. PATENT DOCUMENTS

| | | | | |
|---|---|---|---|---|
| 5,188,166 | A | 2/1993 | Perry | |
| 5,588,479 | A | 12/1996 | Leadbeatter et al. | |
| 5,704,414 | A * | 1/1998 | Breviere | 164/428 |
| 6,032,722 | A | 3/2000 | Russell et al. | |
| 6,296,046 | B1 | 10/2001 | Jeong et al. | |
| 6,651,729 | B1 | 11/2003 | Marti et al. | |
| 6,655,447 | B1 | 12/2003 | Marti et al. | |
| 7,594,534 | B2 | 9/2009 | Marti et al. | |
| 2006/0102312 | A1 | 5/2006 | Poloni et al. | |
| 2007/0006990 | A1 | 1/2007 | Marti et al. | |
| 2007/0220940 | A1 | 9/2007 | Patzelt et al. | |

FOREIGN PATENT DOCUMENTS

| | | | |
|---|---|---|---|
| DE | 19919354 | A1 | 11/1999 |
| EP | 1088609 | A1 | 4/2001 |
| EP | 1646464 | B1 | 11/2006 |
| EP | 1670603 | B1 | 1/2007 |
| EP | 1539405 | B1 | 12/2008 |

(Continued)

*Primary Examiner* — Kevin P Kerns
(74) *Attorney, Agent, or Firm* — The Webb Law Firm

(57) ABSTRACT

A twin roll caster and a method for operating comprising two casting rolls that delimit a casting gap on its longitudinal sides; two side plates that delimit the casting gap on its narrow sides; and at least one axial actuator associated with one of the side plates and impacting the respective side plate on its rear turned away from the front sides of the casting rolls with a force axially aligned toward the casting gap pressing the side plate against the front sides of the casting rolls. An axial actuator acts on the rear side of the side plate by means of a joint provided to adjust an angular offset between the normal level relative to the effective direction of the force applied by the axial actuator to the side plate and the normal level relative to the axes of rotation of the casting rolls.

20 Claims, 2 Drawing Sheets

FOREIGN PATENT DOCUMENTS

| | | | | |
|---|---|---|---|---|
| GB | 2 337 016 | A | * | 11/1999 |
| JP | 3174954 | A | | 7/1991 |
| JP | 5-237603 | A | * | 9/1993 |
| JP | 5237603 | A | | 9/1993 |
| WO | 2005023458 | A1 | | 3/2005 |

* cited by examiner

METHOD AND TWIN ROLL CASTER FOR THE PRODUCTION OF STRIP CAST FROM A MOLTEN METAL

BACKGROUND OF THE INVENTION

When casting strip according to the twin roll casting process, the oppositely-rotating casting rolls of the caster delimit the longitudinal sides of the casting gap. On its narrow sides, however, the casting gap is sealed by a side plate in each case.

The side plates are usually comprised of an insert and a support plate, which bears the insert. The insert in this case is usually made from refractory material and is formed so that it partly covers the front sides, associated with it, of the casting rolls and completely covers the narrow side, to be delimited by it, of the casting gap.

The relative movements, necessary in the casting process, between the side plates and the front sides of the casting rolls as well as the contact with the molten metal moving through the casting gap inevitably lead to wear of the side plate due to abrasive wear. This is particularly true if the contact between the side plates and the molten metal or the casting rolls is realised by means of an insert made from refractory material.

In order that, in the case of side plates equipped with such inserts, it is ensured that the side plates perfectly fulfil their sealing function also at the start of the casting process, it is necessary to grind in the inserts before the casting process begins. For this purpose the respective side plate is adjusted while the casting rolls are rotating until the inserts of the respective side plate lie with the required contact pressure against the respective associated front sides of the casting rolls. Thereupon abrasive wear of the insert material occurs in the region of the contact surfaces.

This condition is maintained until the casting rolls are ground in to a certain required depth into the refractory material of the insert and the insert lies closely fitting against the front sides of the casting roll. The inserts of the side plates now have one section, the so-called "positive insert", projecting into the casting gap, and two sections, the so-called "insert grinding surfaces", adjacent thereto, springing back in relation to the positive insert, with which sections they lie against the front sides of the casting rolls. Here the positive insert with its lateral edge surface covers a narrow margin, adjacent to the respective casting roll front side, of the peripheral surface of the casting rolls in each case.

Because the side plates, possibly by means of their respective insert, are in direct frictional contact with the cooled casting rolls during the casting process, heat is constantly removed from them. Therefore, during the casting process, the temperature of the side plates is usually lower than the temperature of the molten mass coming into contact with them. Consequently heat is also removed from the molten mass when it touches the side plates. The heat loss in this case can be so great that molten mass solidifies on the respective positive insert. In the case of side plates equipped with an insert made from refractory material, such "parasitic solidifications" can take place, particularly in the region of the positive insert.

Parasitic solidifications can cause strip defects, such as thickness discontinuities (deviation from defined tolerances), insufficient through-solidification (bulging aspects) and material tears (strip edges). In extreme cases they may require the casting process to be aborted.

It is known that wear of the insert due to contact with solidifying molten mass can be reduced by moving the insert during the casting process in a precisely pre-determined way relative to the molten mass that is to be cast. For this purpose the side plates are oscillated rotationally about a centrally arranged axis. With this rotational oscillation it is equally possible to counteract solidifications in the lower third of the insert and to counteract the wear increasing downwards. Examples of this procedure are described in Japanese Patents JP 03-174954, JP 05-237603 or U.S. Pat. No. 5,188,166.

In order to ensure sound, integral contact of the side plates on the front sides of the casting roll associated with them in each case, the side plates are usually moved with regulated force against the front sides of the casting roll before the start of the casting operation. If a certain force is reached, the casting process is started. In the proceeding casting operation, the contact pressure necessary for sound sealing is then maintained.

Due to different thermal dilatations, unevenness of the surfaces of the side plates coming into contact with the front sides of the casting rolls, axial misalignment of the casting rolls and other reasons, in practice it is necessary during the casting operation to constantly regulate and readjust the contact pressure, under which the side plates are kept pressed against the front sides of the casting rolls. This is valid in particular for such side plates, wherein sealing takes place by means of an insert, coming into contact with the casting rolls, made from refractory material. In particular constant regulation of the contact pressure is necessary due to the wear of the inserts, which increases as the casting progresses.

The necessary contact pressures are usually applied by actuators, which deliver a force aligned toward the casting gap. Their effective direction is usually aligned substantially axially parallel to the axes of rotation of the casting rolls.

A fundamental problem when regulating the positioning of the side plates against the casting rolls is that, while the casting rolls are rotating, vertical forces develop in consequence of friction between the side plates and the front sides of the casting rolls. The latter is valid in particular if the side plates have an insert made from refractory material, lying against the casting rolls.

The vertical forces increasing proportionally to the axial force applied to the side plates or proportional to the amount of friction have a strong influence on the pressure distribution along the contact arc surfaces, by means of which the side plates lie against the front sides, each associated with them, of the casting rolls. With increasing vertical force the axial pressure rises in the upper region and falls correspondingly in the lower section of the side plates, the force detected on an axial cylinder remaining unchanged. The result of this is that the side plate wears more heavily in its upper section than in its lower section.

The same is also true in the horizontal direction if different friction conditions prevail between the respective front sides of the casting rolls and the side plates. In the case of side plates equipped with an insert made from refractory material and coming into contact with the casting rolls, in practice a difference in thickness of several millimetres between the upper and lower section, or left and right section relative to the vertical, of the insert arises due to the wear that accompanies this. Consequently the total insert thickness cannot be used but the life span of the inserts is determined by the section in which the maximum wear takes place. Furthermore the wear, which is particularly heavy in the region of certain sections, means that as the casting progresses, the positive insert projects further and further into the casting space, as a result of which the dimensional precision of the cast strip is impaired in its width direction, in particular when strip is cast over a long period.

The problems described above arise particularly intensively in the case of such twin roll casters, wherein for reasons of space and cost savings the axially adjustment of the side plate aligned against the front sides of the casting rolls is carried out by only one axial cylinder. Casters equipped in this way are described for example in U.S. Pat. Nos. 5,588,479 and 6,296,046.

In International Patent WO 05/023458 it is proposed to counter these disadvantages by distributing the axial contact pressures in a way that is adapted to the respective wear pattern arising on the respective side plate during casting. The technical cost necessary for this, however, is substantial, since not only complicated control and regulation techniques but also actuators which work in a sophisticated manner must be made available.

SUMMARY OF THE INVENTION

Against this background, the object of the invention was to create a twin roll caster and to indicate a method for its operation, by means of which in a simple and economical way the side plates can be pressed against the front sides, associated with them, of the casting rolls in such a way that maximum utilisation over their life span is made possible.

An inventive twin roll caster, comprising two casting rolls that delimit a casting gap between them on its longitudinal sides and two side plates that delimit the casting gap on its narrow sides, is equipped in accordance with the example from the state of the art with at least one axial actuator, which is associated with one of the side plates and impacts the respective side plate on its rear turned away from the front sides, associated with it, of the casting rolls with a force axially aligned toward the casting gap, through which the side plate is kept pressed against the front sides, associated with it, of the casting rolls.

Now the axial actuator acts according to the invention on the rear of the side plate by means of a joint. This is formed in such a way that it adjusts an angular offset between the normal level relative to the effective direction of the force applied by the axial actuator on the respective side plate and the normal level relative to the axes of rotation of the casting rolls. Since the joint proposed according to the invention is able to adjust an offset between the alignment of the force applied by the axial actuator and the axes of rotation of the casting rolls, it is therefore ensured that the side plates always lie with as far as possible homogeneous force distribution against the front sides, associated with them, of the casting rolls.

The joint present in the case of an inventive twin roll caster thus enables tolerances, arising due to wear, structural inaccuracies and heat influences, in the distribution of the axial forces applied onto the respective side plates, to be adjusted. By means of the joint arranged according to the invention between the side plate in each case to be impacted with the axial force and the axial actuator associated with it, it is namely achieved that the side plate, with its surface associated with the casting rolls, always lies as far as possible uniformly against the front sides of the casting rolls, if locally varying wear of the side plate occurs as a consequence of material-related or process-related irregularities.

A twin roll caster formed in the inventive way enables, before the casting operation, the respective side plate to be pressed by means of the axial actuator against the front sides, associated with it, of the casting rolls until a target operating position is reached, in which a defined contact pressure acts between the side plate and the front sides concerned of the casting rolls. The joint provided according to the invention in this case guarantees that the contact pressure, under which the side plate lies against the front sides, associated with it, of the casting rolls is uniformly distributed to the optimum.

With the invention therefore a twin roll a caster is made available, wherein with only one axial actuator, sound, integral contact between side plate and casting roll is produced in such a manner that optimally uniform wear of the side plate takes place, which enables the side plate to be used over its maximum life span. This is shown to then be particularly advantageous if the side plates of an inventive machine are equipped with inserts made from refractory material which guarantee the seal of the casting gap during the casting operation by being kept pressed against the front sides of the casting rolls.

In order to be able to optimally adjust an angular offset occurring in practice, the joint provided according to the invention should be mobile in at least two degrees of freedom. Under consideration of the wear patterns occurring in practice, a joint which is mobile in three degrees of freedom can for example be used.

For the joints used according to the invention, cardan joints or ball joints can be used by way of example. Particularly simple in terms of construction and at the same time robust, the adjustment movements necessary for the inventive purpose can be facilitated in that the joint is formed as a uni-ball joint.

The operating reliability of a twin roll caster according to the invention can be additionally increased by providing a locking device for arresting the joint after a certain operating position of the respective side plate has been reached. Such a locking device enables the joint to be arrested after the respective target operating position has been reached in order to ensure that the desired even pressure distribution is soundly maintained permanently also under the movements and deformations of the caster inevitably arising during the casting operation.

In practice the locking device can be formed as an adjustable clutch for example. This can be configured so that, when operated, it holds the joint by frictional connection.

Expediently the locking device is coupled with a control device which, when a certain operating position of the respective side plate has been reached, emits a control signal, whereupon the locking device arrests the joint in its respective position.

The exact positioning of the respective side plate on the front sides, associated with them, of the casting rolls can also be assisted if the respective side plate is flexibly biased by spring action against the axial actuator. On the one hand any play existing in the respective joint can be eliminated by such bias. On the other hand as a result of the spring action it can be guaranteed that the side plate is also held in a central position with maximum mobility of the joint, as a result of which any uneven wear of the side plate is prevented. This then proves particularly advantageous if the side plate possesses an insert made from refractory material, since as a result of the flexible bias by spring action and the uniform alignment of the side plate that is thereby ensured, it is possible to prevent insert failures as a consequence of uneven wear.

A particularly effective flexible bias can be obtained if for the flexible bias by spring action at least three spring elements distributed around the working axis of the force applied by the axial actuator are provided. The uniformity of the adjustment in this case can be particularly assisted if the spring elements are distributed at equal angular intervals around the working axis.

In practice the axial actuator can be formed as a positioning cylinder. High forces in a small area can be produced if such a positioning cylinder operates hydraulically.

In order to counteract parasitic solidifications on the side plates during the casting operation, an oscillation device may be provided for oscillating the side plate about an oscillation axis.

DESCRIPTION OF THE PREFERRED EMBODIMENTS

Figure 1:
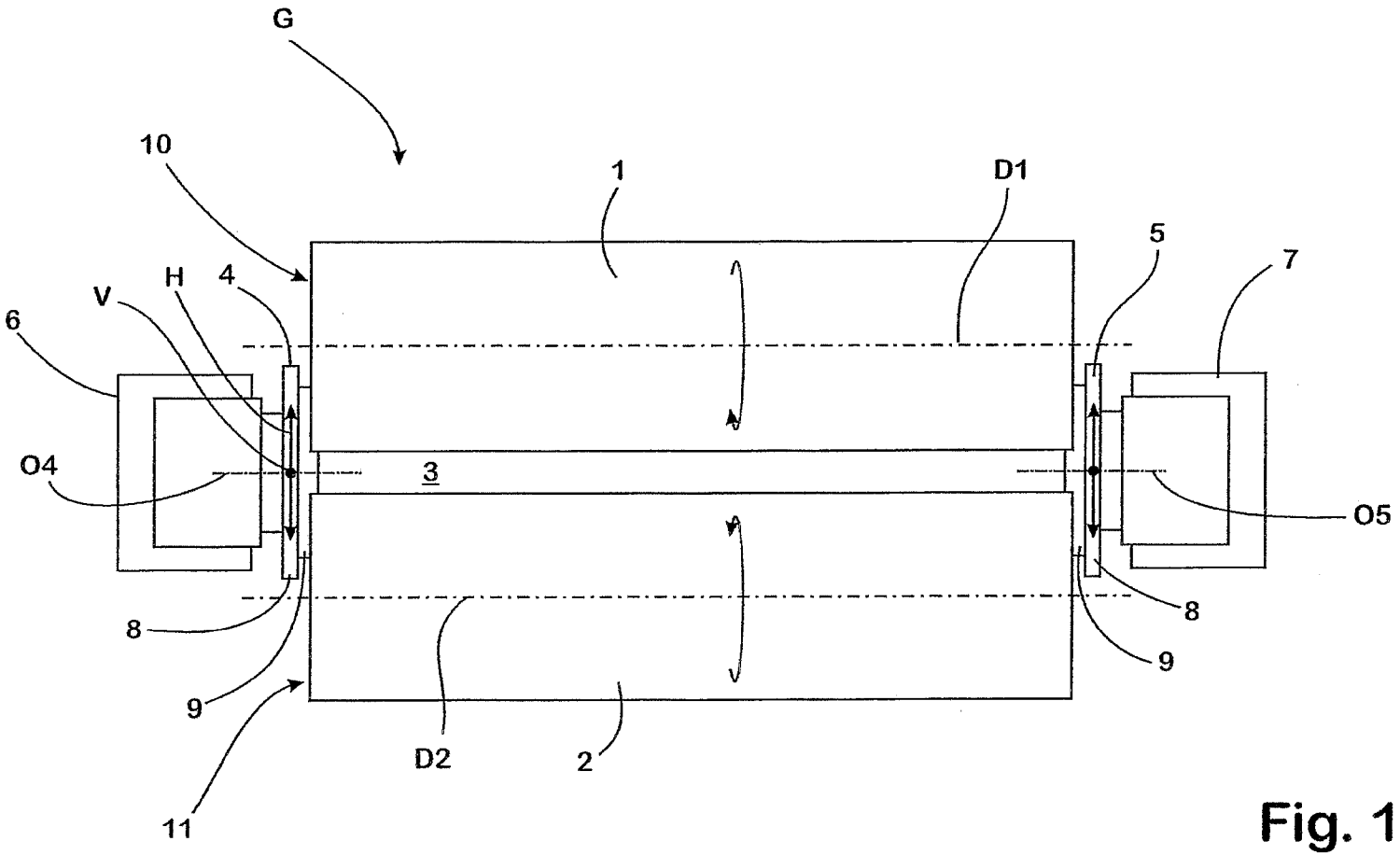
FIG. 1 is a twin roll caster according to the present invention viewed from above.

The twin roll caster G has two casting rolls 1, 2, which each rotate in the opposite direction about a horizontally aligned axis of rotation D1, D2. The casting rolls 1, 2 delimit a casting gap 3 between them on its longitudinal sides.

On its narrow sides the casting gap 3 is sealed by a respective side plate 4, 5, which is respectively supported by a supporting structure 6, 7. The supporting structures 6, 7 each comprise an oscillation device, which oscillates the side plate 4, 5 associated with it during the casting operation about an axis of oscillation O4, O5 in each case.

The side plates 4, 5 each comprise a steel support plate 8, which on its side associated with the casting gap 3 bears an insert 9 made from a refractory material. The shape of the inserts 9 is selected in such a way that it superimposes the front sides 10, 11, associated with it, of the casting rolls 1, 2 in an insert grinding surface 12, 13 by way of an arc of a circle in each case.

The insert grinding surfaces 12, 13 have been ground in into the insert 9 over the course of a start up process of the twin roll caster G carried out according to specific instructions after the respective side plate 4, 5 has been newly fitted with a new insert 9, by abrasive removal of material. They delimit a positive insert 14 between them, freely projecting opposite these into the casting gap, which with its arc-shaped side surfaces 15*a*, 15*b* lies closely against the peripheral surface of the casting roll 1, 2, associated with the respective side surface 15*a*, 15*b*.

The supporting structures 6 or 7, associated with the side plates 4 or 5, are each formed identically.

Figure 2:
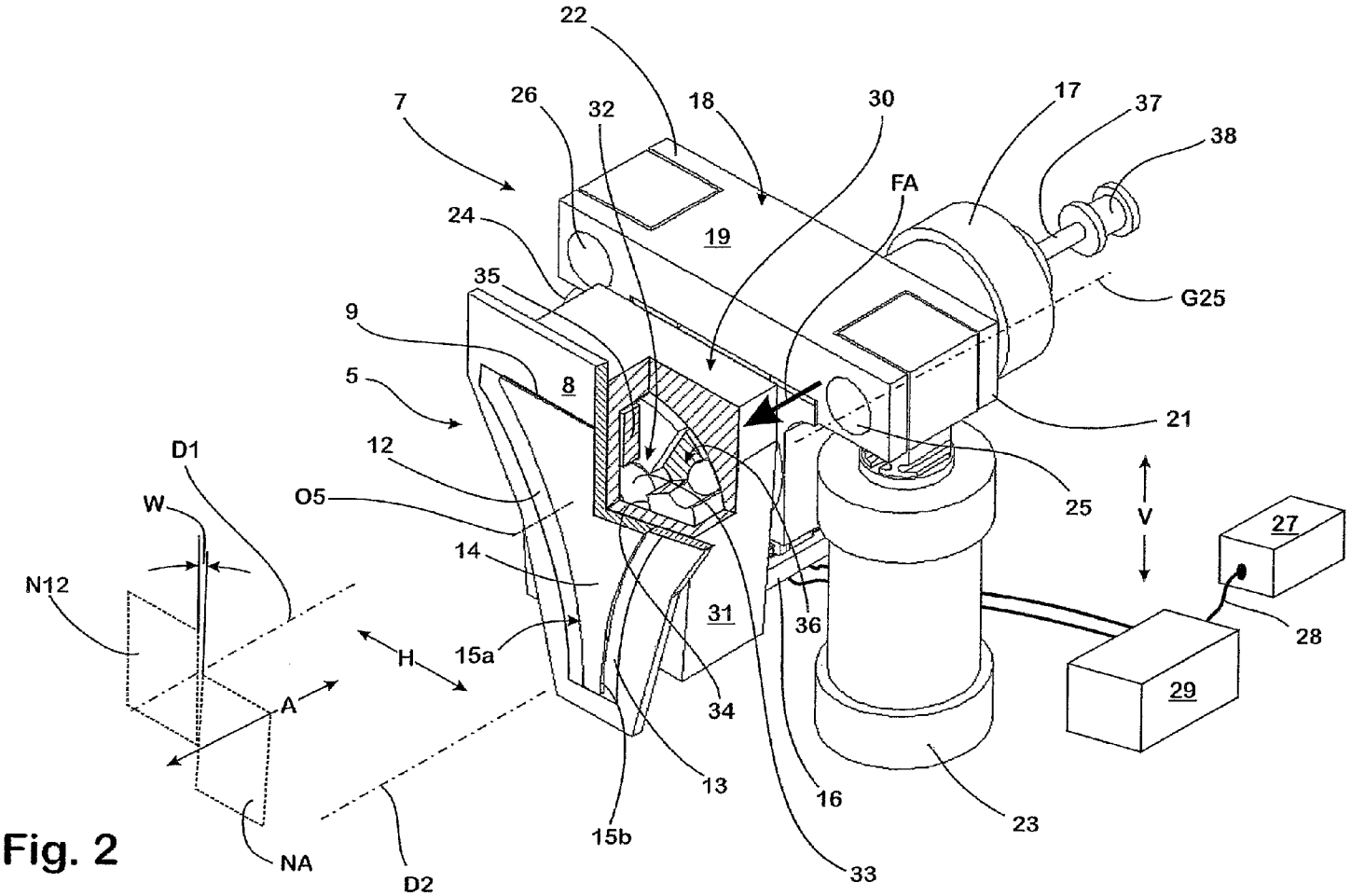
FIG. 2 is a perspective view of an adjustment device for a side plate used in the twin roll caster illustrated in FIG. 1.

As illustrated in FIG. 2 based on a possible embodiment of the adjustment device associated with the side plate 5, the supporting structure 7 in the case of this embodiment is displaceably mounted on a guide 16 in the horizontal direction A of the axes of rotation D1, D2. An axial positioning cylinder 17 serving as axial actuator is provided for adjustment in the axial direction A. During the casting operation this holds the respective side plate 5, with its insert, under a certain predetermined pressure in contact with the respective front sides 10, 11 of the casting rolls 1, 2.

The axial positioning cylinder 17 in this case acts in the horizontal direction A on a T-shaped support frame 18, which supports the side plate 5. In this way the axial positioning cylinder 17 impacts the side plate 5 with a contact pressure FA necessary for the side plate 5 to lie permanently closely against the front sides 10, 11, associated with it, of the casting rolls 1, 2.

The support frame 18 has an upper crosspiece 19 and a middle housing section, suspended thereon, of the support frame 18.

In each case a hydraulically-operable adjusting cylinder 23, 24 is coupled articulatedly to the free end sections 21, 22 of the crosspiece 19. The adjusting cylinders 23, 24, operable independently from one another, have a casing and a piston which is adjustable in the vertical direction, whose piston shaft, guided out of the casing, is connected with its free end in each case by a joint 25, 26 to the end section 21 or 22 associated with it. Observed from above, the one adjusting cylinder here is arranged on the one side and the other adjusting cylinder on the other side of the axis of oscillation O5.

The adjusting cylinders 23, 24 are each supported hydrostatically in order to be able to absorb the transverse forces possibly occurring during the adjustment, produced by the axial positioning cylinder 17, of the respective side plate 4, 5, in axial direction A, the transverse forces being directed into the casting gap 3, for example.

The adjusting cylinders 23, 24 form actuators, with the aid of which the respective side plate 4, 5 may be moved about its respective axis of oscillation O4, O5 in an oscillating manner. For this purpose the adjusting cylinders 23, 24 perform upwardly and downwardly aligned adjustment movements, for example each opposite to one another in the vertical direction V. Likewise for example the adjusting cylinder 23 can be arrested with its piston in a certain extended position, while the second adjusting cylinder 24 carries out further adjustment movements. The axis of oscillation O5 is thereby shifted to the axis G25 of the joint 25, in which joint the adjusting cylinder 21 is articulatedly coupled to the crosspiece 19. Moreover the adjusting cylinders 23, 24 can at the same time or sequentially perform a lowering movement aligned in the same direction, in order to lower the position of the axis of oscillation O5 in the vertical direction V.

The adjusting cylinders 23, 24 move as a function of control signals from a control device 27, which are connected to the adjusting cylinders 23, 24 by means of corresponding control lines 28 and valve devices 29. According to the control signals transmitted by means of the control lines 28, the valves of the valve devices 29 open or close, in order to extend or retract the pistons of the adjusting cylinders 23, 24 and accordingly swivel the side plate 5 by means of the crosspiece 19 into the one or other direction about the axis of oscillation O5.

The adjusting cylinders 23, 24 in this way together form actuators, which together with the control device, associated with them and the valve device additionally provided where necessary as part of an oscillation device, move the side plate 5 in an oscillating manner.

The casing section of the support frame 8 is fastened to the crosspiece 19 by means of a sliding guide, not visible here. In the sliding guide the casing section may be moved in a horizontal direction H, aligned transversely to the axes of rotation D1, D2, relative to the crosspiece 19 and therefore also transversely to the guide 16 and the axes of rotation D1, D2 of the casting rolls 1, 2 by means of an adjusting cylinder, not visible here, serving as actuator for this direction of movement.

The sliding guide itself is suspended by means of two additional adjusting cylinders, likewise not illustrated here, on the crosspiece 19 of the support frame 18. These additional adjusting cylinders, likewise independently operable, together form an actuator, with which the casing section and with it the respective side plate 5 can also again be moved in the vertical direction V relative to the crosspiece 19, in order to additionally superimpose a movement aligned in the vertical direction V onto the oscillating movement of the side plate 5. Observed from above here the one additional adjusting cylinder is arranged on the one side and the other additional adjusting cylinder on the other side of the axis of oscillation O5. In this way it is not only possible to adjust the side plate 5 by coordinated operation of the additional adjusting cylinders in a uniform movement in the V direction, but, during asynchronous, alternating operation of the additional adjusting cylinders, to adjust the side plate 5 in the direction V step by step in a see-saw movement. The adjustment movement, carried out where necessary, of the additional adjusting cylinders is thereby superimposed onto the adjustment movements of the adjusting cylinders 23, 24.

The side plate 5 is coupled by means of a coupling device 30 to the front side, turned toward the casting rolls 1, 2, of the casing section.

The coupling device 30 comprises a casing 31, which on its front side associated with the casting rolls 1, 2 supports the respective side plate 5. In addition the coupling device 30 comprises a joint 32, by means of which the axial positioning cylinder 17 is articulatedly coupled with the side plate 5.

The joint 32 is formed as a uni-ball ball joint, the ball 33 of which is supported by the middle casing section of the support frame 18 and the pan 34 of which is inserted into the casing 31 of the coupling device 30. By means of three spring elements 35 made from flexible material and distributed at equal angular intervals around the working axis, coinciding with the axial direction A, of the contact pressure FA, the pan 34 is pulled against the ball 33 of the joint 32, so that it is substantially free from play. At the same time the spring elements 35 ensure that the side plate 5 in the unbiased condition is aligned in a defined target position relative to the axial direction A.

By means of the joint 32, an angular offset W, illustrated in FIG. 2 with exaggerated large size for clarity, can be adjusted between the normal level NA relative to the working direction A of the force FA applied by the axial actuator 17 to the respective side plate 5 and the normal level N12 relative to the axes of rotation D1, D2 of the casting rolls 1, 2. This can not only, as indicated in FIG. 2, extend in two directions in space but as a consequence of corresponding deformations can naturally also be aligned in three directions in space.

Furthermore a locking device 36, formed as a clutch and only indicated here but not illustrated in detail, is provided for arresting the joint 32. This is designed for example according to the device described in US Patent US 2007/0220940 A1 in such a way that on the one hand in the un-arrested condition it permits the necessary mobility of the joint 32 and on the other hand by relative adjustment of two clutch members—not visible here—one of which is coupled to the ball 33 and the other is coupled to the pan 34 of the joint 32 by means of clutch elements arranged therebetween—likewise not visible here—it can arrest the joint 32, in its respective position reached, by way of frictional and positive force of the clutch members and clutch elements. The necessary relative adjustment of the clutch members is carried out in this case by an actuating device 37. This adjusts the clutch members and clutch elements of the locking device by means of a ram 38 as a function of a control signal, which is emitted by a control device—likewise not illustrated here.

Before the start of casting, the side plate 5 is moved by the axial positioning cylinder, position-regulated with superimposed force control in the axial direction A against the front sides 10, 11, associated with it, of the casting rolls. If a defined force threshold is reached, wherein sound contact between the insert 9 and the front sides 10, 11 is guaranteed, the joint bearing is mechanically arrested by the locking device 36 in the way described above, upon a corresponding signal from the control device not shown, associated with the locking device 36. At the same time the target operating position of the side plate 5 reached in this condition is stored in a memory of a control device associated with the axial positioning cylinder 17.

After the joint has been arrested, it is fundamentally possible to immediately set the casting rolls 1, 2 into rotation.

However when starting the casting rolls 1, 2 slowly in order to prevent stick-slip effects, that is to say short term intensive adhering of the insert 9 onto the front sides 10, 11 at the beginning of rotation of the casting rolls 1, 2 and the accompanying danger of a failure of the insert 9, it is advantageous now to firstly retract the side plate 5 by means of the axial positioning cylinder so far that contact pressure no longer prevails between the front sides 10, 11 and the insert 9. In addition, this time period can be used for adapting the temperature of the insert 9 to the temperature of the casting rolls 1, 2. After a critical minimum speed of the casting rolls 1, 2 has been exceeded, the side plate 5 can then be moved to the target operating position, stored previously, and the casting operation can be started.

REFERENCE SYMBOLS

1, 2 casting rolls
3 casting gap
4, 5 side plates
6, 7 supporting structure
8 support plate
9 insert
10, 11 front sides of the casting rolls 1, 2
12, 13 insert grinding surfaces
14 positive insert
15*a*, 15*b* side surfaces
16 guide
17 axial positioning cylinder
18 T-shaped support frame
19 upper crosspiece of the support frame 18
21, 22 free end sections of the crosspiece 19
23, 24 adjusting cylinders
25, 26 joints
27 control device
28 control lines
29 valve devices
30 coupling device
31 casing of the coupling device 30
32 joint
33 ball of the joint 32
34 pan of the joint 32
35 spring elements
36 locking device (clutch)
37 actuating device
38 ram
A axial direction of the axes of rotation D1, D2
D1, D2 axes of rotation of the casting rolls
G twin roll caster
FA contact pressure
H horizontal direction of movement
NA, N12 normal levels
O4, O5 oscillation axis of the side plates 4, 5
V vertical direction of movement
W angular offset

The invention claimed is:

1. A twin roll caster comprising:

two casting rolls that delimit a casting gap between them on its longitudinal sides;

two side plates that delimit the casting gap on its narrow sides;

at least one axial actuator, which is associated with one of the side plates and impacts the one side plate on its rear, which is turned away from the front sides of the casting rolls, with a force axially aligned toward the casting gap through which force the one side plate is kept pressed against the front sides of the casting rolls, wherein the axial actuator acts on the rear side of the side plate using a joint, which adjusts an angular offset between the normal level relative to the effective direction of the force applied by the axial actuator to the one side plate and the normal level relative to the axes of rotation of the casting rolls and a locking device, which arrests the joint after a certain angular offset by the joint has been reached.

2. The twin roll caster according to claim 1, wherein the joint is mobile in at least two degrees of freedom.

3. The twin roll caster according to claim 1, wherein the joint is mobile in three degrees of freedom.

4. The twin roll caster according to claim 1, wherein the joint is formed as a cardan joint.

5. The twin roll caster according to claim 1, wherein the joint is formed as a ball joint.

6. The twin roll caster according to claim 5, wherein the joint is formed as a uni-ball joint.

7. The twin roll caster according to claim 1, wherein the locking device is formed as a clutch.

8. The twin roll caster according to claim 7, wherein, when operated, the locking device holds the joint by frictional connection.

9. The twin roll caster according to claim 7, wherein the locking device is coupled with a control device which, when the certain angular offset by the joint has been reached, emits a control signal, whereupon the locking device arrests the joint in its respective position.

10. The twin roll caster according to claim 7, wherein the clutch, in the unarrested condition, permits mobility of the joint by relative adjustment of two clutch members.

11. The twin roll caster according to claim 10, wherein one of the clutch members is coupled to a ball of the joint and another of the clutch members is coupled to a pan of the joint.

12. The twin roll caster according to claim 1, wherein the one side plate is flexibly biased by spring action against the axial actuator.

13. The twin roll caster according to claim 12, wherein for the flexible bias by spring action at least three spring elements distributed around the working axis of the force applied by the axial actuator are provided.

14. The twin roll caster according to claim 13, wherein the spring elements are distributed at equal angular intervals around the working axis.

15. The twin roll caster according to claim 1, wherein the axial actuator is formed as a positioning cylinder.

16. The twin roll caster according to claim 15, wherein the positioning cylinder operates hydraulically.

17. A method for operating a twin roll caster according to claim 1, comprising pressing the one side plate using the axial actuator against the front sides of the casting rolls, until a target operating position is reached, in which a defined contact pressure acts between the one side plate and the front sides of the casting rolls.

18. The method according to claim 17, further comprising arresting the joint after the certain angular offset by the joint has been reached.

19. The method according to claim 17, further comprising retracting the one side plate from the axial actuator by a preset regulation distance before the casting rolls start to rotate, then setting the casting rolls into rotation until a target rotational speed is reached and thereupon using the axial actuator to move the one side plate back again to the target operating position.

20. A method of manufacturing metal strip, comprising:

moving molten metal through a casting gap between two cooled casting rolls and two side plates of a twin roll caster according to claim 1 to form the metal strip.

* * * * *